US005604509A

United States Patent [19]

Moore et al.

[11] Patent Number: 5,604,509

[45] Date of Patent: Feb. 18, 1997

[54] REMOTE DISPLAY MONITOR SYSTEM

[75] Inventors: Ronald L. Moore, San Diego; Thomas P. Rittmaster, Poway; Thomas H. Lupfer, San Diego, all of Calif.

[73] Assignee: Advent Design, Inc., San Diego, Calif.

[21] Appl. No.: 422,580

[22] Filed: Apr. 14, 1995

[51] Int. Cl.[6] ..... G09G 5/12

[52] U.S. Cl. ..... 345/2

[58] Field of Search ..... 345/1–3, 185, 345/201; 359/146

[56] References Cited

U.S. PATENT DOCUMENTS

| | | | |
|---|---|---|---|
| 5,268,676 | 12/1993 | Asprey et al. | 345/2 |
| 5,469,183 | 11/1995 | Takatsuji et al. | 345/2 |
| 5,526,354 | 6/1996 | Barraclough et al. | 345/2 |

*Primary Examiner*—Jeffery Brier
*Attorney, Agent, or Firm*—Thomas J. Tighe, Esq.

[57] ABSTRACT

A monitor is remotely coupled to a source of display data for real-time display of the data thereon. The display is real-time in that the received data is converted to pixel values and is displayed by the remote monitor almost instantaneously except for some minor data hand-off and transmission delays. The remote monitor can be any kind of conventional text and/or graphics display device, e.g. a cathode ray tube device, but preferably is a flat panel, digital display. Preferably the system couples to a pre-existing data bus, e.g. an ISA, EISA, VLB or PCI bus, and an interface circuit communicates with the source of the display information, such as a processor on the bus. Digital pixel values are stored in a local frame buffer. A transmit controller transmits the stored pixel values over a preferably serial, optical transmission medium, to a remote circuit which stores them in a remote frame buffer. A remote processor controls the communication of pixel values from the remote frame buffer to the remote monitor. In some embodiments, the remote processor has data ports, e.g. a keyboard, pointing device and/or a serial port, and can be used to process operator inputs to perform functions such as pan and zoom on the display data. Also data input at the remote monitor can be sent back to the bus interface circuit via a second transmission medium, preferably optical and serial.

20 Claims, 10 Drawing Sheets

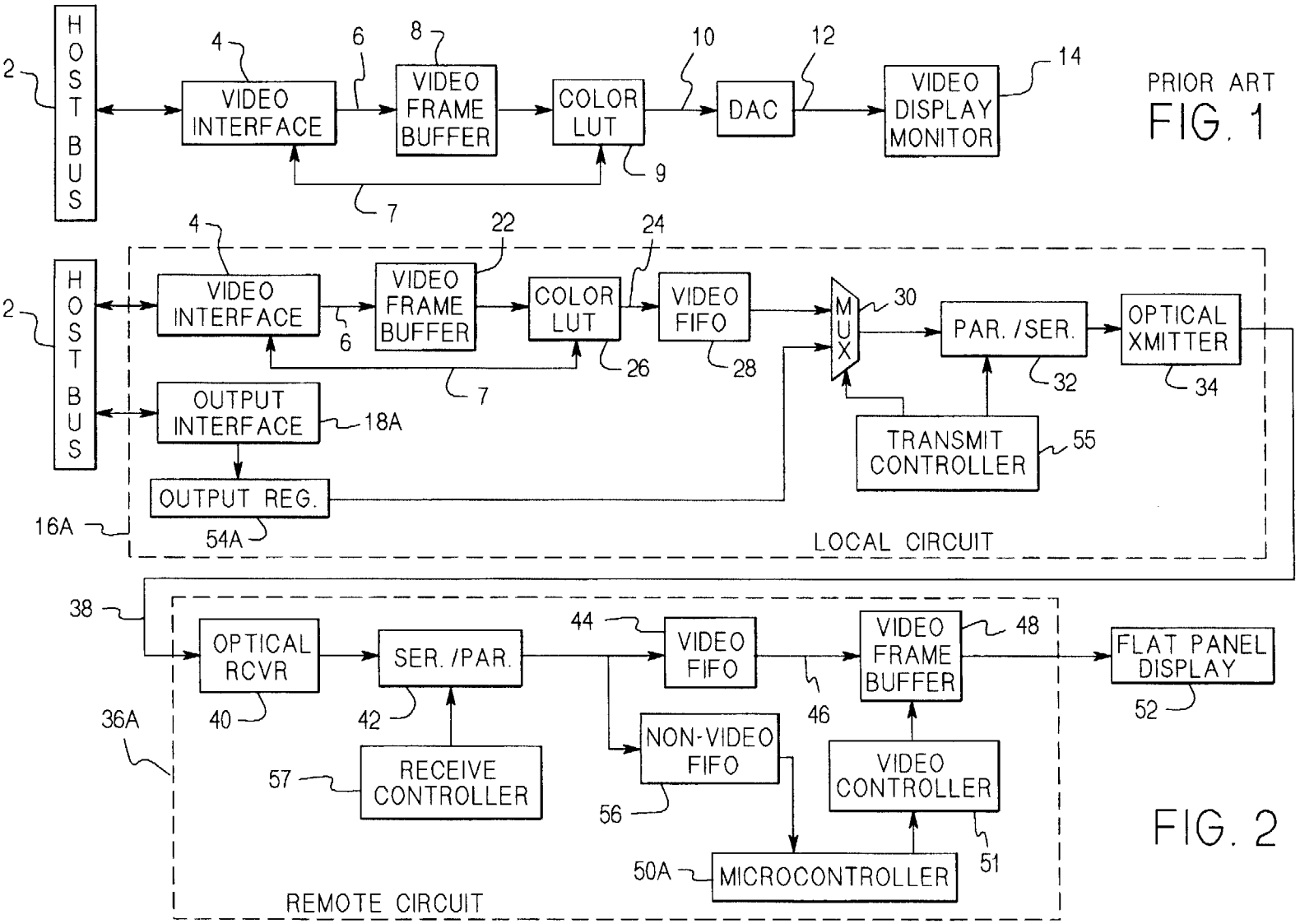
PRIOR ART
FIG. 1
HOST BUS
2
VIDEO INTERFACE
4
VIDEO FRAME BUFFER
6
8
COLOR LUT
9
7
DAC
10
12
VIDEO DISPLAY MONITOR
14
HOST BUS
2
VIDEO INTERFACE
4
VIDEO FRAME BUFFER
6
22
COLOR LUT
24
26
VIDEO FIFO
28
7
MUX
30
PAR./SER.
32
OPTICAL XMITTER
34
TRANSMIT CONTROLLER
55
OUTPUT INTERFACE
18A
OUTPUT REG.
54A
LOCAL CIRCUIT
16A
38
OPTICAL RCVR
40
SER./PAR.
42
VIDEO FIFO
44
46
VIDEO FRAME BUFFER
48
FLAT PANEL DISPLAY
52
RECEIVE CONTROLLER
57
NON-VIDEO FIFO
56
VIDEO CONTROLLER
51
MICROCONTROLLER
50A
REMOTE CIRCUIT
36A
FIG. 2

REMOTE DISPLAY MONITOR SYSTEM

BACKGROUND OF THE INVENTION

This invention relates in general to apparatuses that allow a fully functional, real-time video monitor or terminal to be remote from a source of display data, such as a data processor.

The advantages and attributes of this invention will be readily discernable upon a reading of the text hereinafter.

SUMMARY OF THE INVENTION

An object of this invention is to provide a system that allows a fully functional, real-time video monitor or terminal to be located remote from a source of display data, such as a data processor.

A further object of this invention is to provide a system for transferring video data from a circuit local to a data processor to a remote display circuit without going through an analog stage.

These objects, and other objects expressed or implied in this document, are accomplished in one embodiment by a system for remotely coupling a real-time display monitor to a source of real-time display data, the system comprising: (a) an interface circuit coupled to the source for receiving units of display data, e.g. frames, from the source, (b) a first memory, e.g. a frame buffer, for storing a unit of display data received by the interface circuit, (c) a data transmission medium having a port remote from the first memory, (d) a circuit for periodically retrieving display data stored in the first memory and communicating it via the medium to the medium's remote port, (e) a circuit for receiving display data from the remote port, (f) a second memory, e.g. a frame buffer, for storing a unit of received display data, (g) a circuit for retrieving display data stored in the second memory and communicating same to the display monitor for display thereon.

BRIEF DESCRIPTION OF THE DRAWINGS

FIG. 1 is a functional block diagram illustrating prior art.

FIG. 2 is a functional block diagram of a first embodiment of this invention.

DESCRIPTION OF THE PREFERRED EMBODIMENT

Figure 3:
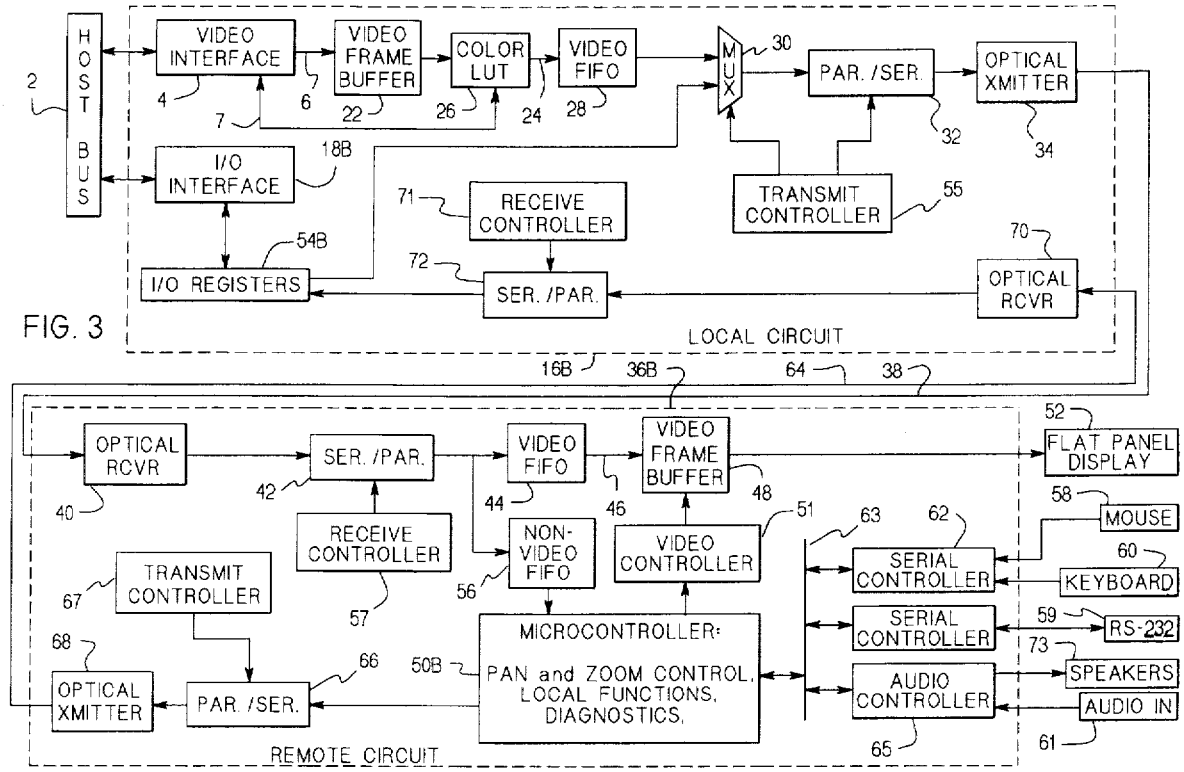
FIG. 3 is a functional block diagram of a second embodiment of this invention.

As used herein, the terms "light" and "optic" and "optical" all refer to electromagnetic radiation in a wavelength range including infrared, visible, ultraviolet and X rays. All the embodiments presented herein include a serial transmission medium, which is preferably but not necessarily a medium for the transmission of light signals, and the term "remote" as used herein to modify, i.e. describe, a thing indicates that the thing is located at an end of the transmission medium remote from the host bus.

Referring to FIG. 1, a prior art local graphics display circuit and display monitor are illustrated. A host bus 2 communicates with a local video interface 4. The "host bus" 2 can be any type of data processing bus such as those having an open architecture. Examples are: SBUS or SUNBUS, MULTIBUS, ISA bus, EISA bus, VLB bus and PCI bus. The video interface typically has bus drivers and receivers, and a controller portion that receives data and commands from a data processor (not shown) via the bus and returns status and data to the data processor also via the bus. The data transfers are usually in a parallel format. The data 6 from the bus interface is stored in a video memory, such as a video frame buffer 8, which typically comprises an array of random access memory (RAM). The stored data is an ordered group of addresses, and periodically the stored addresses are accessed and communicated in a predetermined order to a color LUT (look-up table) 9 which maps each address to a corresponding digital value, i.e. a pixel color value. A typical color LUT allows for many possible colors but only a limited number of colors at any given time, the limited number being the values that get loaded into the color LUT from the video interface via path 7. The pixel color values 10 from the color LUT are communicated to a digital-to-analog converter (DAC) 11 which converts the digital values to an analog signal 12. The analog signal is communicated to, and displayed on, a display device 14 such as a video display monitor that is local relative to the host bus. The rate at which the addresses in the frame buffer are read and applied to the color LUT is controlled by a video pixel clock which for a standard video graphics array (VGA) display having 640 columns by 480 rows is 25.175MHz. The typical frame refresh rate for a non-interlaced VGA display is 60 Hz. The local graphics display circuit is typically incorporated onto a motherboard or is made as an add-on card.

Referring to FIG. 2, a first embodiment of the system according to this invention is illustrated to have a circuit 16A local to the host bus 2. A video interface 4 performs basically the same functions as in the prior art, that is, it communicates with a data processor via the bus, responds to processor commands, and stores addresses 6 in a video frame buffer 22. Also as in the prior art the addresses are communicated to a color LUT 26 which provides corresponding digital pixel color values ("video data") 24. However instead of converting the video data to an analog signal via a DAC, this invention keeps the pixel color values in their digital form and stores them in a first-in/first-out memory (FIFO) 28. From there, through a multiplexer (MUX) 30, the video data is communicated to a serializer (PAR./SER.) 32 that converts the data from parallel to serial form and communicates the serialized data to an optical transmitter (OPTICAL XMITTER) 34. The transmitter converts the serialized data to corresponding light signals and communicates them across a fiber optic cable 38 to a remote circuit 36A.

Referring again to FIG. 2, the timing of the writing of video data 24 into the local circuit's FIFO 28 is controlled by a clock which can be separately generated or be derived from the video pixel clock discussed above in connection with FIG. 1. Since there is no local display needing to be refreshed and since transfers from the video interface 4 to the frame buffer 22 are controlled by a conventional separate interface frequency source, the FIFO write clock can be reduced in frequency from the video pixel clock without affecting the transfer rate between the processor, via the host bus, and the frame buffer. The timing of the video data transfers from the FIFO and through the MUX 30 to the serializer 32 is controlled by a frequency source (e.g. crystal oscillator or phase locked loop) which is selected to maximize the transfer rate of the serial link.

Referring again to FIG. 2, at the remote circuit 36A the light signals transmitted across the optical link 38 by the local circuit 16A are sensed by an optical receiver (OPTICAL RCVR) 40. The sensed signals are converted back to parallel form by a de-serializer (SER./PAR.) 42, and if the sensed signals contain video data, it is communicated to remote a video FIFO 44 from which the video data 46 is shifted to a remote video frame buffer 48. Under the control of a microcontroller 50A and video controller 51, the video data is read from the video frame buffer and provided to preferably a flat panel display monitor 52 at a sufficient rate to meet the refresh requirements of the display panel. Since the data stored in the remote frame buffer are pixel color values, no remote color LUT is needed, and since the display 52 is preferably digital, no remote DAC is needed. A frequency source incorporated in the remote circuit 36A (preferably crystal oscillator or phase locked loop) is used to provide the timing for de-serializing the received data and for writing to the remote video FIFO 44.

The first embodiment of FIG. 2 also contains a feature by which a data processor, via the host bus, can send types of data ("non-video data") other than color LUT addresses to the remote circuit. When the processor sends non-video data over the bus, an output interface 18A is made aware of this fact according to the design of the bus. The output interface then loads this data into a temporary holding memory, illustrated as an output register 54A, and interrupts a transmit controller 55. The transmit controller manages the reading of data from the FIFO 28, the selection of which mux 30 input passes through the mux, and further controls the serializer 32. When so interrupted the transmit controller temporarily halts the reading of video data from the FIFO, during the halt the controller causes: (1) the mux 30 to pass the non-video data from the output register to the serializer, and (2) the serializer to serialize and specially encode the non-video data. As will be explained, certain link commands that are encoded within the serial protocol of the link indicate to the remote circuit 36A that the data being transferred is non-video data. Once serialized and so encoded, the non-video data is transmitted to the remote circuit.

Referring again to FIG. 2, when non-video data is received by the remote circuit's de-serializer 42, it is recognized as non-video data by a receive controller 57. This recognition causes the receive controller to write the data into a non-video FIFO 56 rather than the video FIFO 44 and raise an interrupt to the microcontroller 50A which remains as long as the FIFO is not empty. The non-video data can be, for example, pan and zoom commands, that are processed by the controller to cause the video controller 51 to vary accordingly the way the video data is transferred from the frame buffer to the display. This process is more fully explained below with reference to the embodiment of FIG. 3.

Referring again to FIG. 2, the overall rate at which frames of video data are obtained from the local color LUT 26, serialized, transmitted over the optical link 38, sensed from the link, de-serialized and written into the remote frame buffer 48 via the remote video FIFO 44 can be called the "frame transfer rate." Preferably the remote frame buffer is an array of video random access memory (VRAMs) that can be accessed for writes and reads asynchronously, and so frames of video data can be read from the remote frame buffer at a rate necessary to satisfy the refresh needs of the display (e.g. 60 Hz) while frames of video data can be written into the frame buffer at the substantially reduced frame transfer rate.

In practicing this invention, the frame transfer rate is selected according to the type of information that will be displayed on the remote monitor. For multimedia applications which include moving pictures, a transfer rate of thirty frames per second is probably adequate. For applications in which only alphanumerics are displayed, a transfer rate of ten frames per second is probably adequate. For combinations of the two, the higher rate is preferred.

Referring to FIG. 3, a second embodiment is illustrated to have the same structure as the first embodiment but also to include a return path from the remote circuit 36B to the host bus 2 for operator inputs coming from the location of the remote display 52. The operator inputs can be of any kind and number, but as illustrated they include inputs from a "mouse" 58 (which can be any kind of pointing device), a keyboard 60, an RS-232 serial port 59, and an input from an audio source 61. Preferably one serial controller 62 receives inputs from the mouse and keyboard, and a second one provides the RS-232 port, the two serial controllers being in communication with a microcontroller 50B via a microcontroller input/output bus 63 internal to the remote circuit. An audio controller 65 receives the audio signals and communicates them to the microcontroller also via the bus 63. In this embodiment the microcontroller can either process the inputs directly or send the inputs back to the host bus, or a combination of both. For those inputs being sent back to the host bus, the microcontroller communicates them in parallel form, e.g. in bytes, to a serializer 66 and notifies a transmit controller 67 which in turn causes the inputs to be serialized and encoded. An optical transmitter 68 transmits the serialized and encoded inputs, via a second optical cable 64, to an optical receiver 70 in the local circuit 16B. From there they are communicated to a local de-serializer 72 that puts the operator inputs back into parallel form and communicates the de-serialized inputs to one or more I/O registers 54B. A receive controller 71 that manages the de-serializer causes an I/O interface 18B to be aware that the I/O registers contain data from the remote circuit and what type of data has been received (keyboard stroke, audio-in, mouse, RS-232, etc.). The I/O interface then communicates this information to the data processor according to the design of the bus, e.g. by raising an interrupt. The I/O interface and the I/O registers are similar to the output interface 18A and output registers 54A (FIG. 2) of the first embodiment, but further include the capacity to receive, temporarily hold, and make available to the host bus non-video data from the remote circuit.

Referring again to FIG. 3, the microcontroller 50B preferably has some video functions it can perform without needing to send all operator inputs back to a processor on the host bus. For example, it can be programmed to perform pan and zoom functions and other display related functions. It can also be used to perform diagnostics including frame buffer memory tests. Preferably the microcontroller is a programmable microcontroller, such as an 8031, with some read/write memory (not shown) and some read-only memory (not shown) containing the programs to perform the above-described functions. The 8031 also has an integrated serial port which can be used for additional I/O devices, such as a trackball. The microcontroller performs all reads and writes to its peripherals and initializes them upon reset, but by this configuration a host bus processor has control to change any peripheral settings. Preferably the serial controllers 62 are 85C30s and the audio controller 65 is a 79C30 Digital Subscriber Controller providing an audio port for both audio in and audio out such as to speakers 73.

Referring again to FIG. 3, non-video data coming from a data processor on the host bus 2 is stored in the I/O registers 54B and multiplexed to the remote circuit between video data transfers. Eventually it is stored in the non-video FIFO 56 by the remote receive controller 57. Whenever data is present in the non-video FIFO, an interrupt is issued to the microcontroller 50B indicating that the FIFO is not empty. Each item of non-video data preferably comprises two bytes: a first byte being an encoded command to the microcontroller, and the second byte being an operand. Under this scheme the host processor can issue 256 different commands. For example, the first byte can a "write" command to the serial port, and the second byte can be the data to be written to the port. As another example, a first byte can be a peripheral address (peripheral to the microcontroller) and the second byte can define the type of function to perform.

Figure 4:
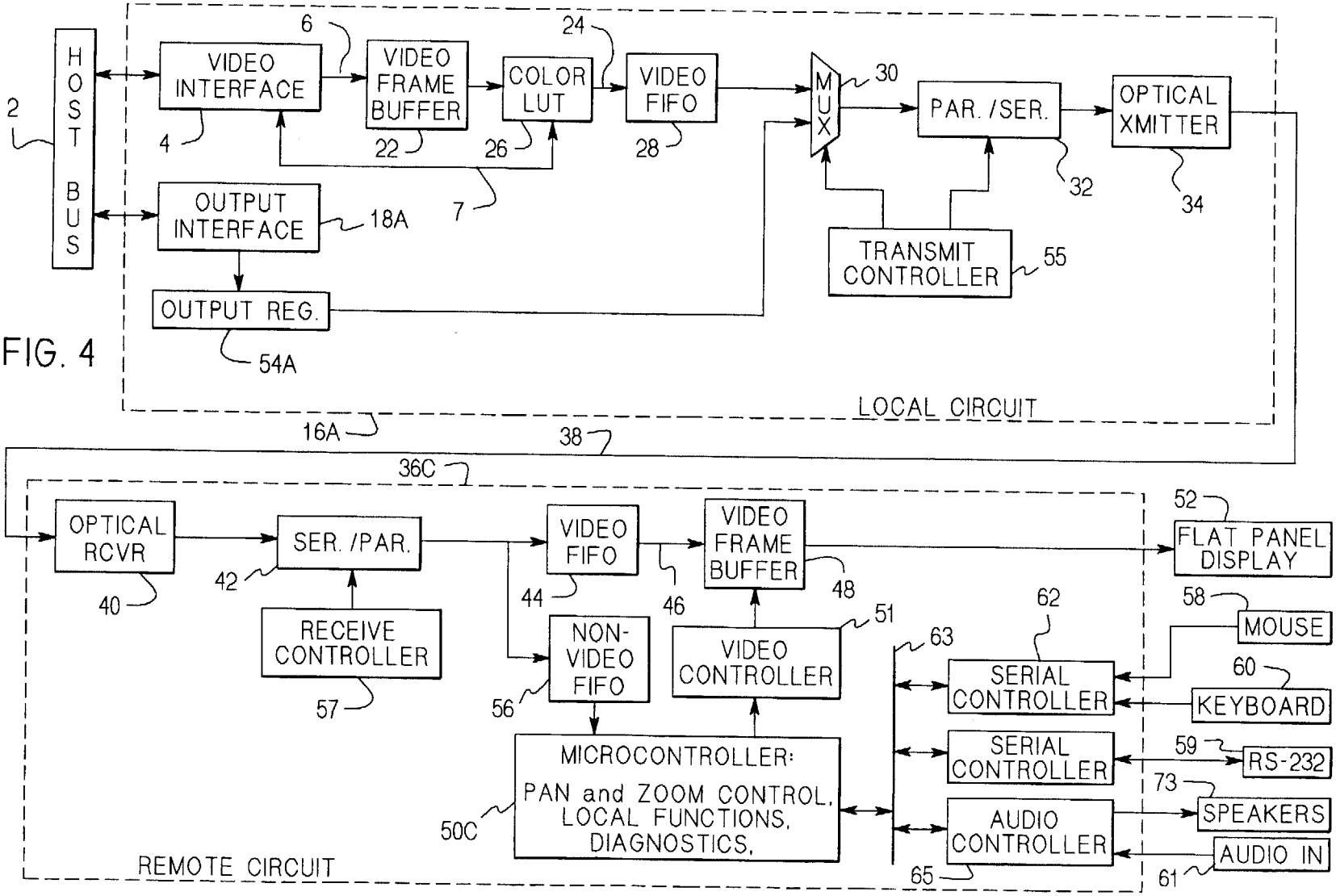
FIG. 4 is a functional block diagram of a third embodiment of this invention.

Referring to FIG. 4, a third embodiment is illustrated to include local circuit 16A that can be the same as the local circuit of the first embodiment (FIG. 2), but further includes a microcontroller 50C and peripherals of the microcontroller (mouse, keyboard, etc.) similar to those of the second embodiment (FIG. 3). However this embodiment does not have a return path for operator inputs such as in the second embodiment. Preferably the microcontroller is programmed to perform pan and zoom functions and other display related functions. It can also be used to perform diagnostics including frame buffer memory tests. Preferably the microcontroller is a programmable microcontroller, such as the 8031. The microcontroller performs all reads and writes to its peripherals and initializes them upon reset, but by this configuration a host bus processor has control to change any peripheral settings. Like the second embodiment, preferably the serial controllers 62 are 85C30s and the audio controller 65 is a 79C30 Digital Subscriber Controller providing an audio port for both audio-in and audio-out such as to speakers 73.

Referring to FIGS. 2–4, the serializers 32 and 66 are preferably implemented using AMD AM7968 transmitter devices or equivalents, and the de-serializers 42 and 72 are preferably implemented using AMD AM7969 receiver devices or equivalents. In this preferred embodiment the AMD AM7968 devices are operated in 9-bit mode (3 bits per RGB) and accept 9-bit data and link commands under a strobe and acknowledgment handshaking protocol. An acknowledgment signal from an AM7968 indicates it is ready to accept new data and link commands. If the command inputs are all logical zero, then a strobe signal communicated to the AM7968 causes it to latch internally the signals applied to its data inputs. The data is then encoded (4-bit/5-bit and NRZI), serialized and shifted out the device's serial outputs. If the command inputs are not all zero, the data inputs are ignored and a command symbol corresponding to the non-zero command inputs is sent via the serial outputs in response to the strobe signal. The AM7969 devices accept the serial signals from the AM 7968's via their serial inputs and decode them. If the received signal pattern is a command symbol, a corresponding command binary code is applied to the command output pins and a command strobe output is pulsed, the command strobe indicating to external circuitry that a command has been received and that the command code is available at the command output pins. If the received signal pattern is data, the data word (in this case 9-bits) is applied to the data output pins and a data strobe is pulsed, the data strobe indicating to external circuitry that a data word has been received and that the data is available at the data output pins. These devices provide the means for asynchronous serial communication, and in the preferred embodiments data transfer rates of 135 megabits per second can be achieved. The optical transmitters 34 and 68 are preferably implemented using Hewlett Packard HFBR-1414 transmitters, and the optical receivers 40 and 70 are preferably implemented using Hewlett Packard HFBR-2416 optical receivers. External 12,888MHz crystals are preferably used for the internal oscillators of the AM7968's and AM7969's.

Referring to FIGS. 3 and 5–12, the I/O interface 18B and the various controllers (51, 55, 57, 67 and 71) are each preferably implemented using one or more programmable logic arrays, and each has a plurality of states, including a "ready" state from which other states originate and to which they all ultimately return. While in the ready state each controller is essentially waiting for one or more signals to prompt it to perform a certain function or series of certain functions, depending on the nature of the prompt signal. While explanation of these functions, i.e. states, which follows pertains to the embodiment of FIG. 3, they can also apply to the embodiments of FIGS. 2 and 4 where appropriate.

Figure 5:
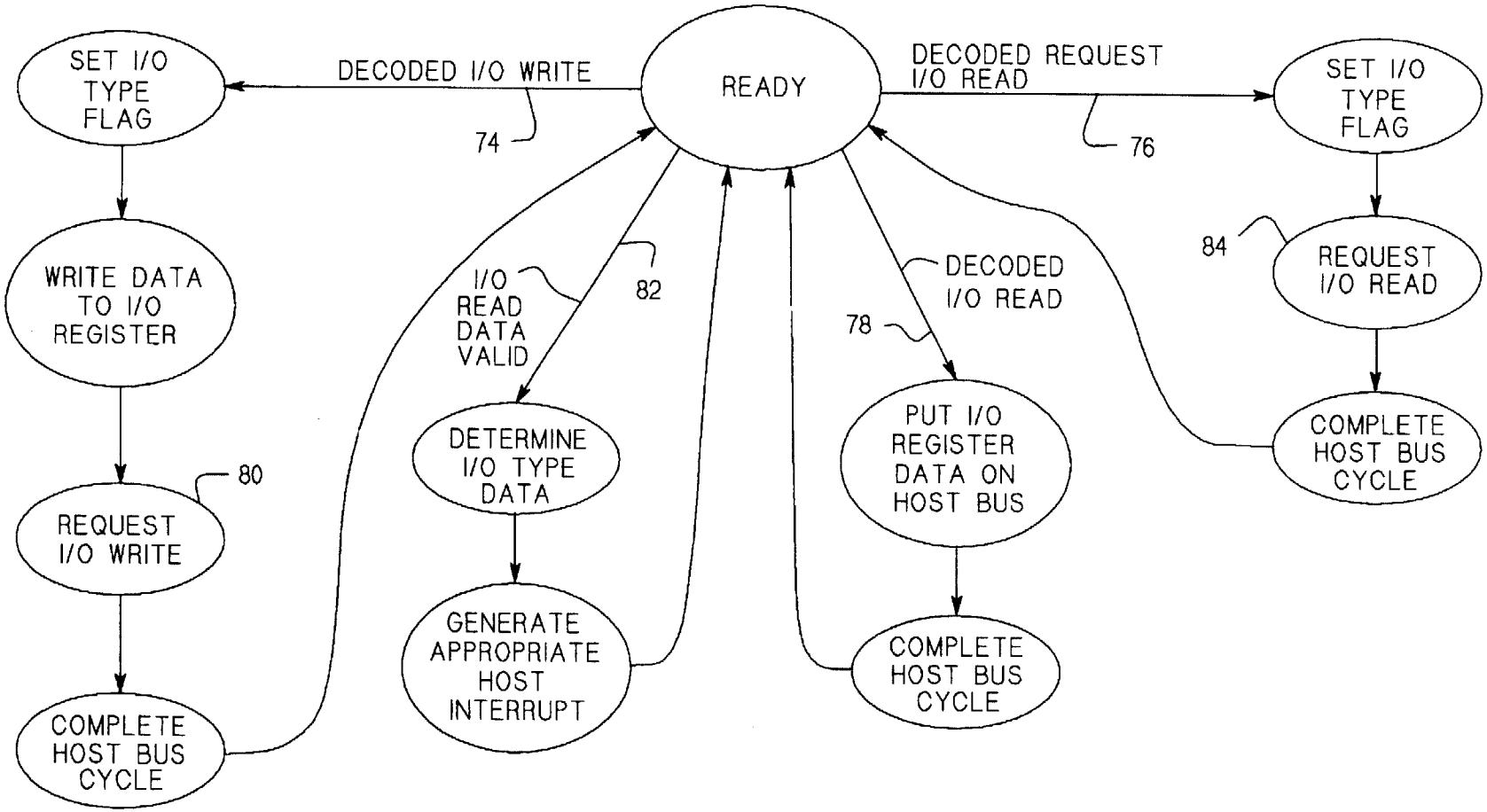
FIG. 5 is a state diagram of a local host I/O interface.

Referring to FIGS. 3 and 5, the I/O interface 18B preferably responds to at least three prompts via the host bus 2 during what are commonly called host bus cycles, and at least one prompt from the local receive controller 71. The host bus prompts include an I/O Write signal 74, a Request I/O Read 76 signal and an I/O Read signal 78. The signals are termed "decoded" because for some conventional buses, such as the S-BUS, the signals are produced by an address decoder (not shown) which decodes corresponding addresses sent via the host bus. The I/O Write signal prompts the interface to set an I/O type flag for the benefit of the local transmit controller 55, retrieve write data (preferably two bytes of non-video data as described above) from the host bus and put it into an I/O write register (one of the registers 54B), and send a request 80 to the local transmit controller to send the write data to the remote circuit. Thereafter the interface returns to the ready state after completing the bus cycle. The Request I/O Read signal prompts the interface to set an I/O type flag and send a request to the local transmit controller to send an I/O read request 84 to the remote circuit in order to retrieve non-video data therefrom. When the remote circuit returns the requested data, as will be explained, the local receive controller 71 puts it into an appropriate I/O register 54B and sends an I/O Read Data Valid signal 82 to the interface. This signal prompts the interface to determine the type of data sent and to generate an appropriate host bus interrupt. The I/O Read signal 78 from the bus prompts the interface to retrieve the data from the I/O register in which it was stored, and put the data onto the host bus.

Figure 6:
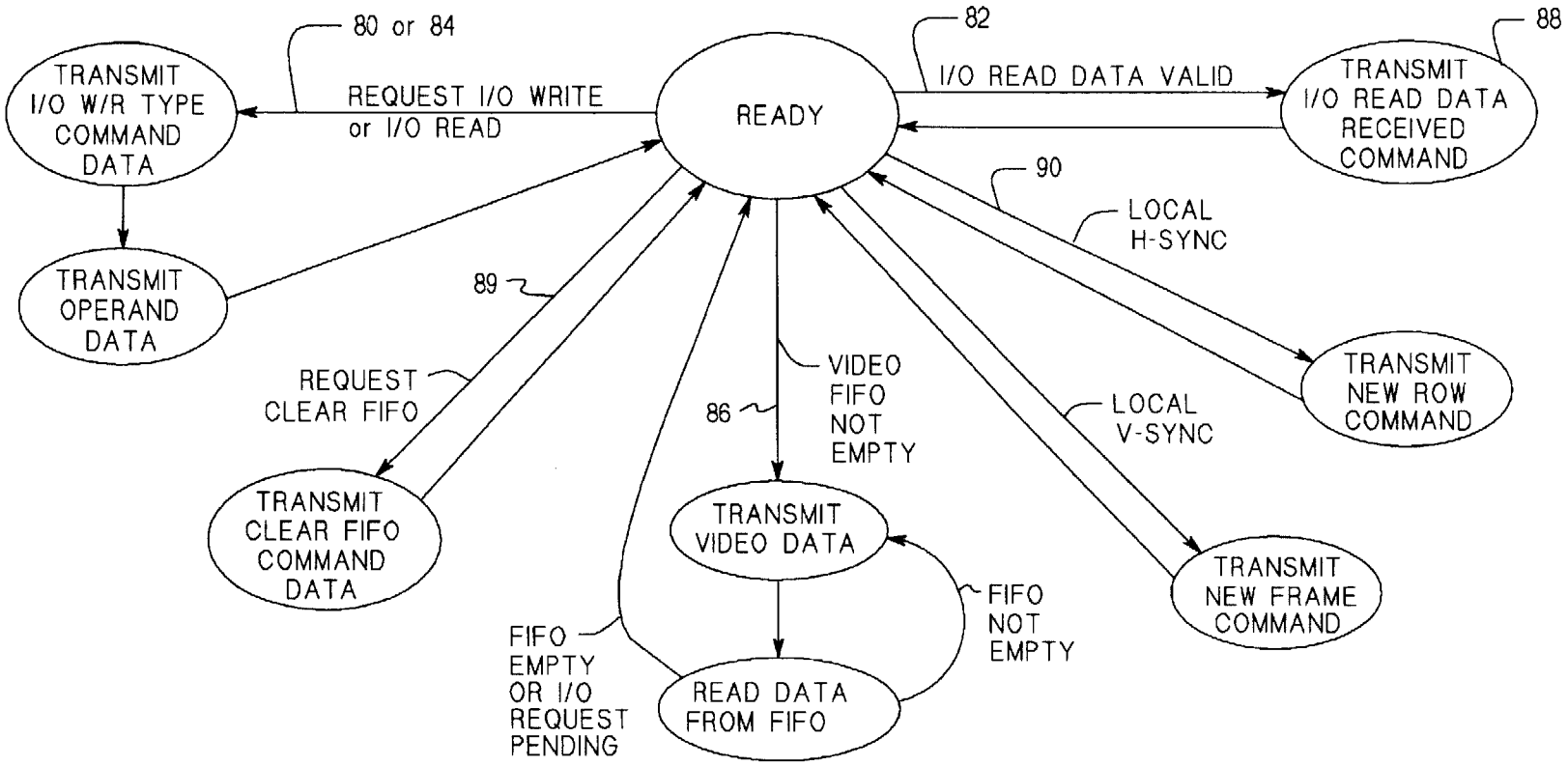
FIG. 6 is a state diagram of a local transmit controller.

Referring to FIGS. 3 and 6, the local transmit controller 55 preferably responds to at least two prompts from the I/O interface 18B, a prompt from the video FIFO 28, a prompt from the local receive controller 71, and two pseudo horizontal (H-Sync) and vertical (V-Sync) synchronizing signals preferably generated by a local video generator. For example, the SBUS uses an LSI 64825 IC. In response to a Video FIFO Not Empty signal 86, indicating that the local video FIFO 28 has unsent video data in it, the transmit controller retrieves and sends video data from the FIFO to the serializer 32 via the MUX 30. This is what the transmit controller is normally doing. In response to the Request I/O Write signal 80 or the Request I/O Read signal 84, from the I/O interface, the transmit controller stops sending video data for one cycle and selects the I/O registers 54B (containing the non-video data pertaining to the request) to pass through the MUX 30 and be sent to the remote circuit 36B. For an I/O write request, the 1st byte of the non-video data is preferably an I/O write type of microcontroller command and the 2nd byte is an operand, e.g. the write data. For an I/O read request, the 1st byte is preferably an I/O read type of microcontroller command and the 2nd byte can either modify the first byte or simply be a dummy byte. The remote circuit recognizes the non-video data as such because the transmit controller also causes the serializer to include in the non-video data transmission a link command unique to such a transmission, preferably a code of 0x03.

Referring again to FIGS. 3 and 6, the I/O Read Data Valid signal 82 from the local receive controller 71 (described above in connection with FIG. 5) prompts the local transmit controller 55 to send the remote circuit a signal 88 (I/O Read Data Received) acknowledging receipt of the read data. It does this by causing the serializer to transmit a link command corresponding to the signal, preferably a code of 0x05. The transmit controller is prompted by vertical (V-Sync) and horizontal (H-Sync) synchronizing signals that are produced by local frame row and column counters (not show) clocked by a local "pixel clock." In response the transmit controller sends the remote circuit "New Frame" and "New Row" signals, respectively, by causing the serializer to transmit corresponding link commands, preferably 0x02 and 0x01 respectively. The transmit controller can also be prompted by a signal 89 from the I/O interface to send the remote circuit a signal to clear the non-video FIFO of data, and it does this by causing the serializer to transmit a corresponding link command, preferably 0x04.

Figure 7:
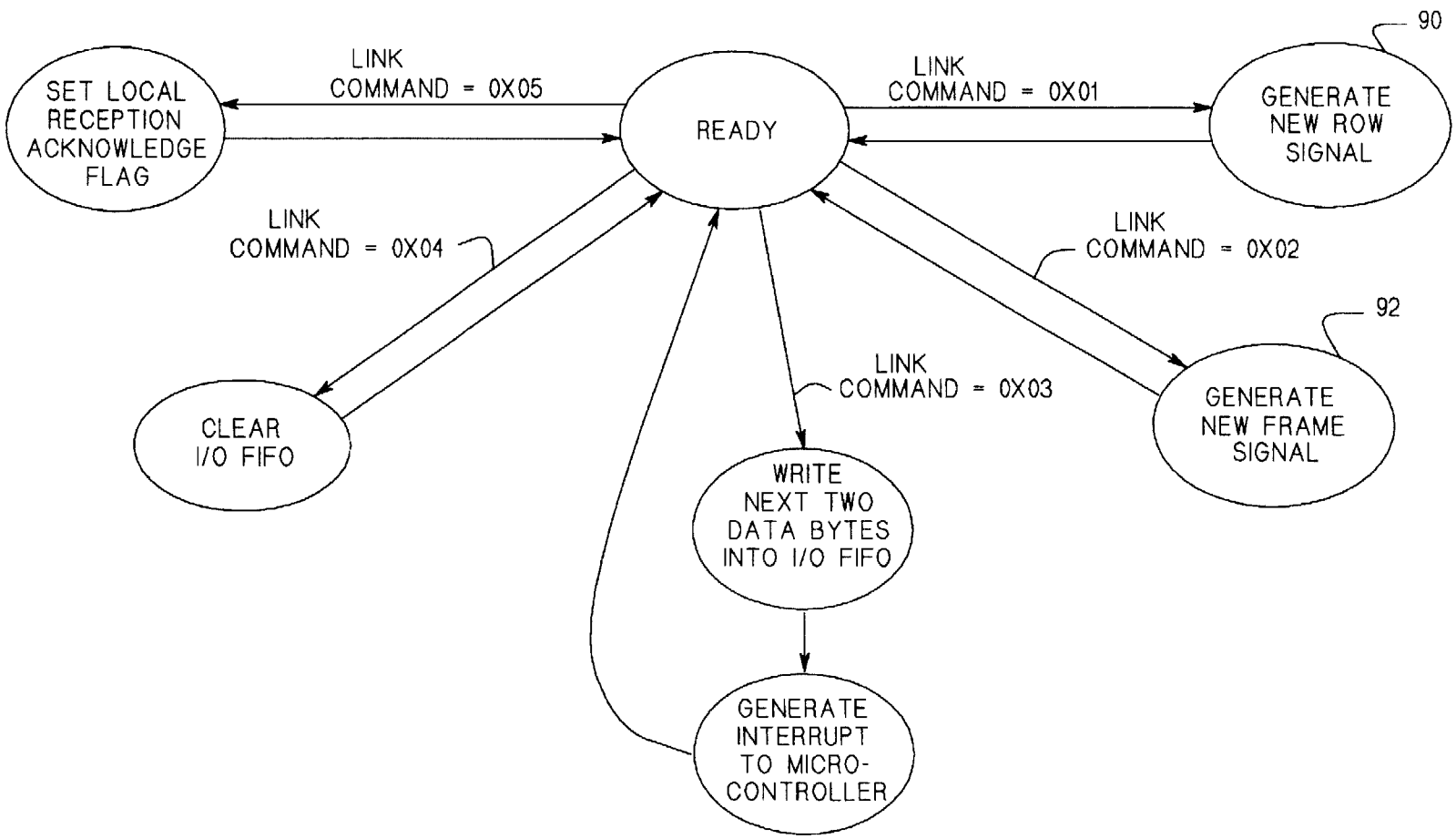
FIG. 7 is a state diagram of a remote receive controller.

Referring to FIGS. 3 and 7, the remote receive controller 57 is prompted by signals from the remote de-serializer 42 that correspond to the above-described link commands, preferably 0x01–0x05, caused to be sent by the local transmit controller 55. For codes 0x01 and 0x02, the remote receive controller generates new row 90 and new frame 92 signals, respectively. These signals are communicated to the video controller 51 for transferring video data from the remote video FIFO to the remote video buffer. For code 0x03, the receive controller writes the next two bytes of data received by the de-serializer 42 into the non-video FIFO 56 rather than the video FIFO, and it interrupts the microcontroller 50B to let it know that the non-video FIFO is not empty. The microcontroller subsequently retrieves the two bytes from the FIFO, decodes the command byte and acts accordingly. For code 0x04, the receive controller clears the non-video FIFO, and for code 0x05 it sets a "Local Reception Acknowledge" flag. The flag informs the microprocessor that the last I/O read data, sent from the remote circuit to the local circuit, has been read by the host.

Figure 8:
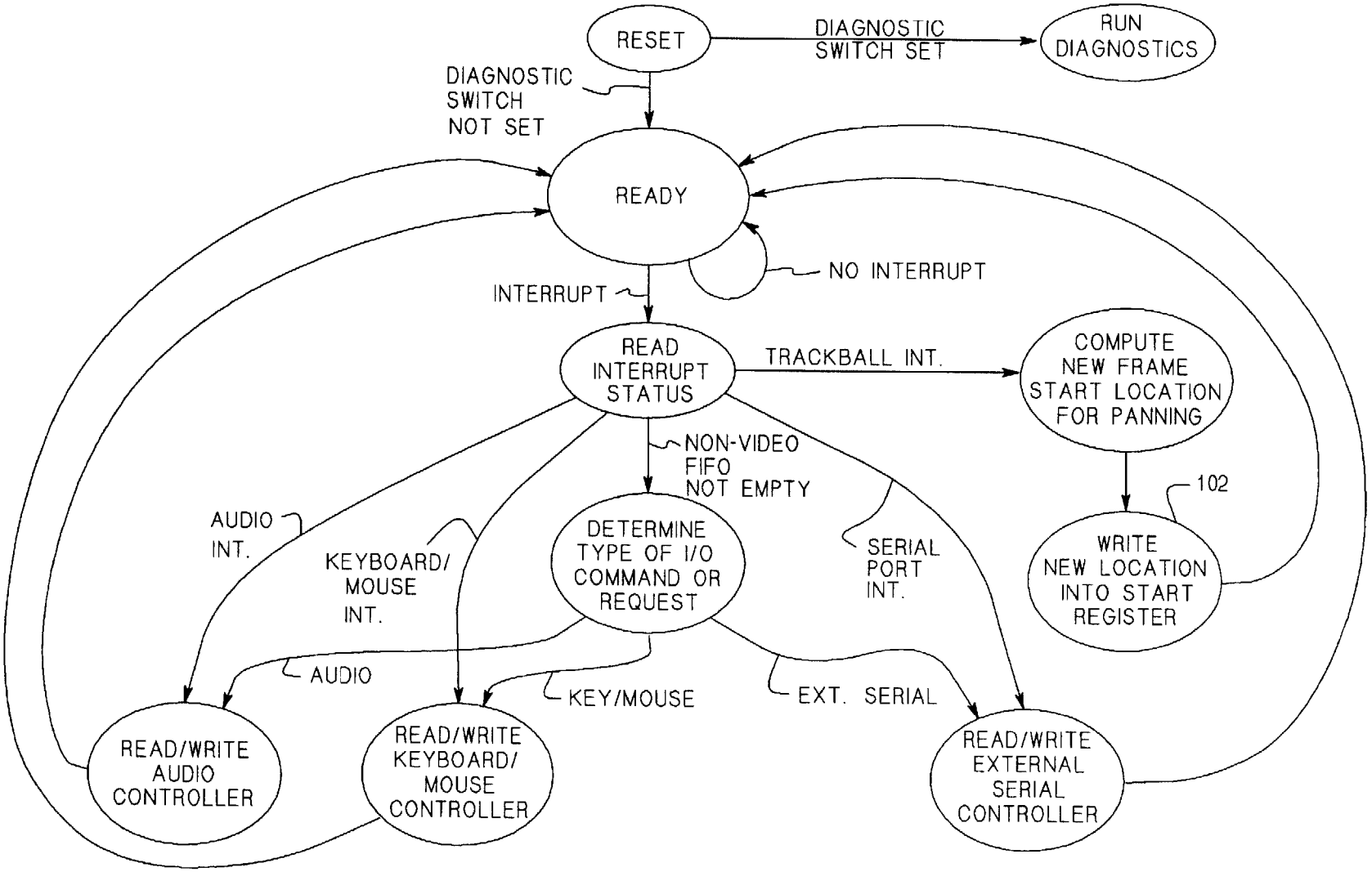
FIG. 8 is a state diagram of a microcontroller.

Referring to FIGS. 3 and 8, following a reset the microcontroller 50B can run diagnostics if a diagnostic switch is set, or otherwise enter the ready state. The switch is preferably a jumper. When in the ready state the microcontroller waits for an interrupt. When an interrupt occurs, the microcontroller reads an interrupt status word to determine the source or sources of the interrupt. The interrupt status word comprises at least all external interrupts as constituent bits. If the current highest priority interrupt was caused by the non-video FIFO not being empty, the microcontroller retrieves the next command data (the preferable two bytes) from the FIFO and determines the type of I/O command or request signified by the command data. The microcontroller then communicates accordingly with the signified I/O device controller, e.g. the audio controller 65, or one of the serial controllers 62. The FIFO not empty interrupts persists until it is empty. If the interrupt came directly from one of the I/O devices, the microcontroller services the interrupt by again communicating with the corresponding I/O device controller. Preferably in the case of a trackball interrupt, the microcontroller computes a new frame starting location for panning and writes the address of the new location in a start register (not shown) which is used to define the origin of the display.

Figure 9:
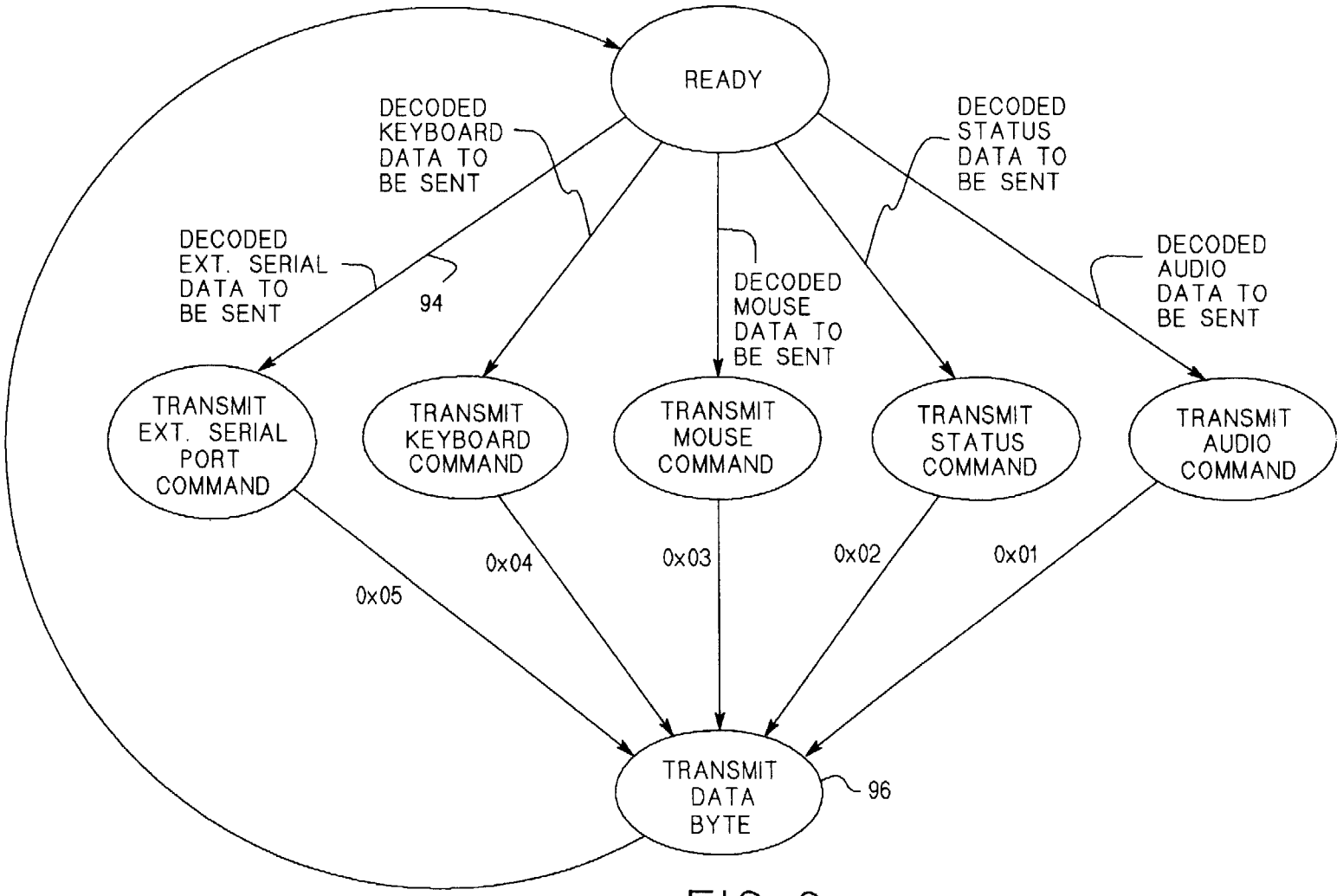
FIG. 9 is a state diagram of a remote transmit controller.
Figure 10:
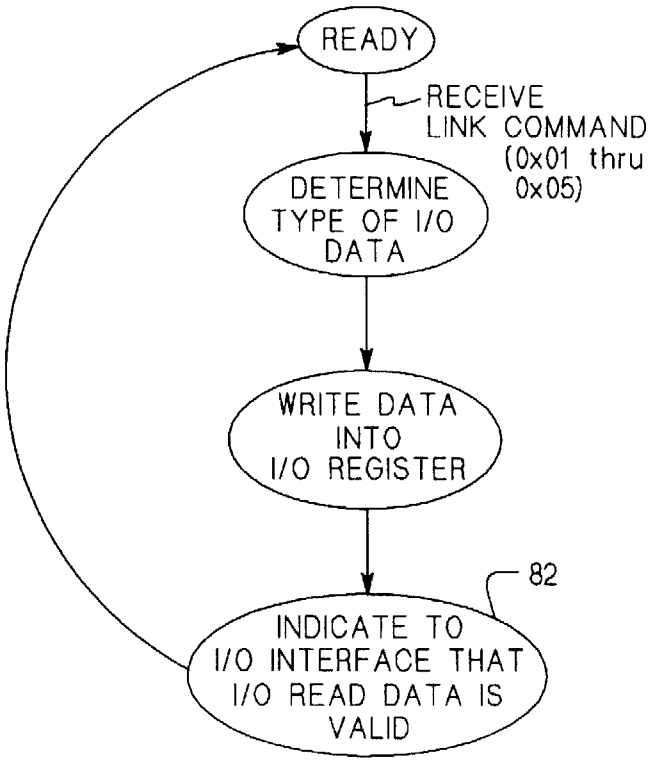
FIG. 10 is a state diagram of a local receive controller.

Referring to FIGS. 3, 9 and 10, a remote transmit controller responds to prompts from the microcontroller. A prompt 94 to send a byte of data from the external serial port results in the transmit controller causing the remote serializer 66 to send a corresponding link command, 0x05, to the local receive controller 71 followed by the byte of data 96 that is provided by the microcontroller to the serializer. When the local receive controller receives the link command, it determines the type of I/O data being sent, writes the data byte following the link command into an appropriate I/O register 54B, and then communicates a signal 82 to the I/O interface 18B that the I/O read data is valid. As explained above with reference to FIG. 5, this signal 82 causes the I/O interface to raise an appropriate host interrupt. In likewise fashion, prompts from the microcontroller to send keyboard, mouse, status and audio data to the local circuit result in the remote transmit controller causing the remote serializer to sent corresponding link commands (0x04, 0x03, 0x02, 0x01 respectively) each followed by a corresponding byte of data. All the data is subsequently stored by the local receive controller in appropriate I/O registers, for access by the host computer via the host bus, followed by the signal 82 informing the I/O interface of that fact.

Figure 11:
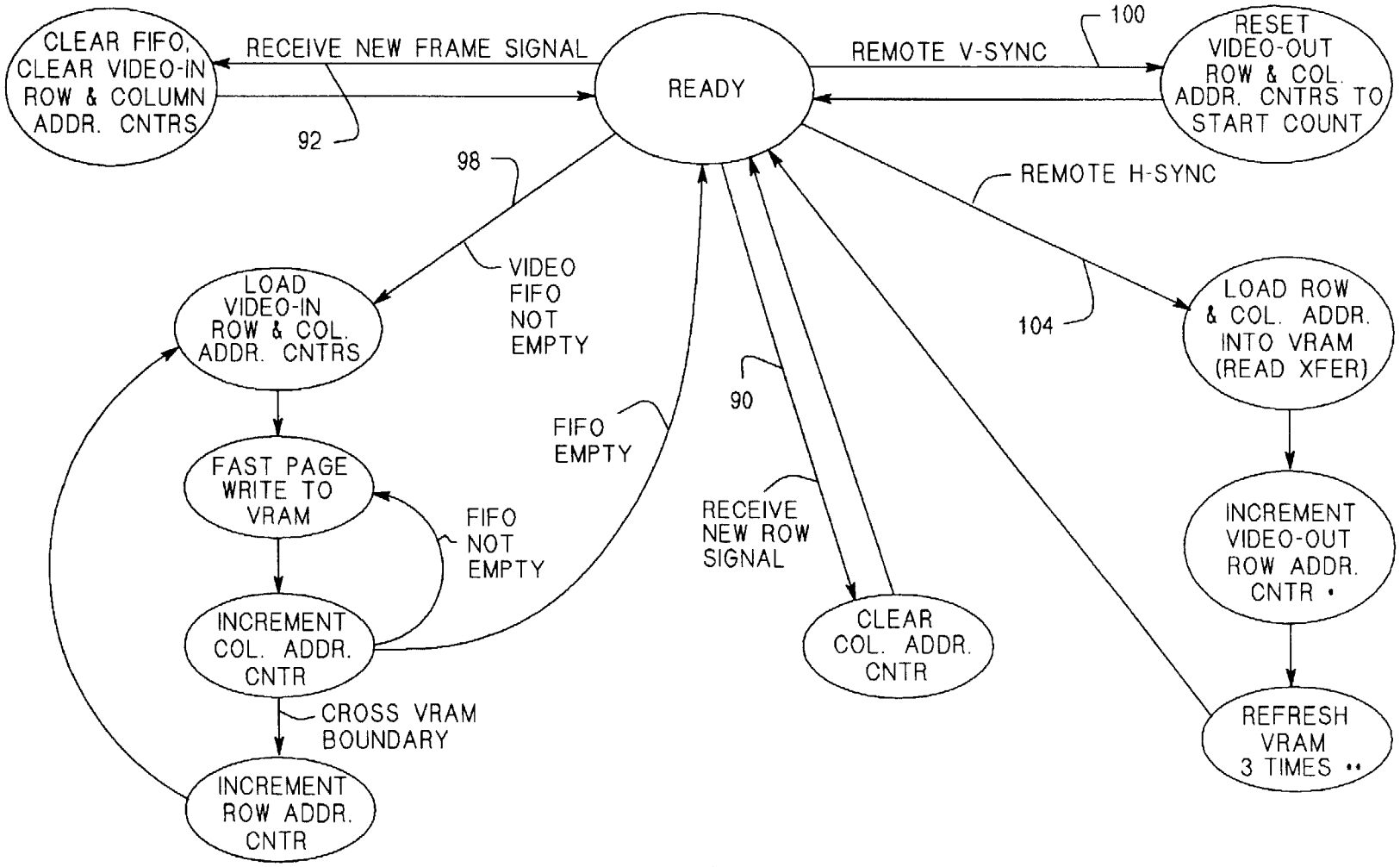
FIG. 11 is a state diagram of a portion of a video controller.

Referring to FIGS. 3, 7 and 11, the remote video controller 51 as illustrated is prompted by the remote receive controller 57, the remote video FIFO 44, and vertical (V-Sync) and horizontal (H-Sync) synchronizing signals produced by a remote pixel clock generator associated with the display 52. For example, the V-Sync can be at 60 Hz and the H-Sync can be at 25.175 Mhz. The new row and new frame signals, 90 and 92, from the remote receive controller prompt the video controller to: (1) clear a video-in column address counter in response to the former, and (2) clear the FIFO, and video-in row and column address counters in response to the latter. The video-in row and column address counters (not shown) are pointers associated with the remote video buffer 48 for loading the video data into the buffer. The video controller is also prompted by a signal 98 whenever the FIFO is not empty to perform writes, preferably fast page writes, from the FIFO to the VRAM of the buffer according to the video-in row and column address counters until the FIFO is empty. The video controller is prompted by the V-Sync 100 to reset video-out row and column address counters to a start count as determined by the contents of a start register (not shown) which is set by the microcontroller. (See FIG. 8, state 102.) The video-out row and column address counters (not shown) are pointers associated with the remote video buffer 48 for reading the video data from the buffer to be sent to the display. The video controller is prompted by the H-Sync 104 to: (1) perform a read transfer from the buffer to the display by loading the current video-out row and column addresses into the VRAM and initiating a read, (2) increment the video-out row address counter depending on the current zoom level, and (3) refresh the VRAM depending on the specific requirements of the VRAM integrated circuits (ICs) and the horizontal sweep rate. For a zoom of one-to-one, the video-out row counter would be incremented every H-Sync, and the column counter would be incremented every pixel clock. For a zoom of two-to-one, the video-out row counter would be incremented once per two H-Syncs, and the column counter would be incremented once per two pixel clocks. For a zoom of four-to-one, the video-out row counter would be incremented once per four H-Syncs, and the column counter would be incremented once per four pixel clocks. The number of times the VRAM is refreshed per H-sync is preferably equal to, or greater than, the minimum refresh rate specified for the VRAM ICs divided by the horizontal sweep rate.

Figure 12:
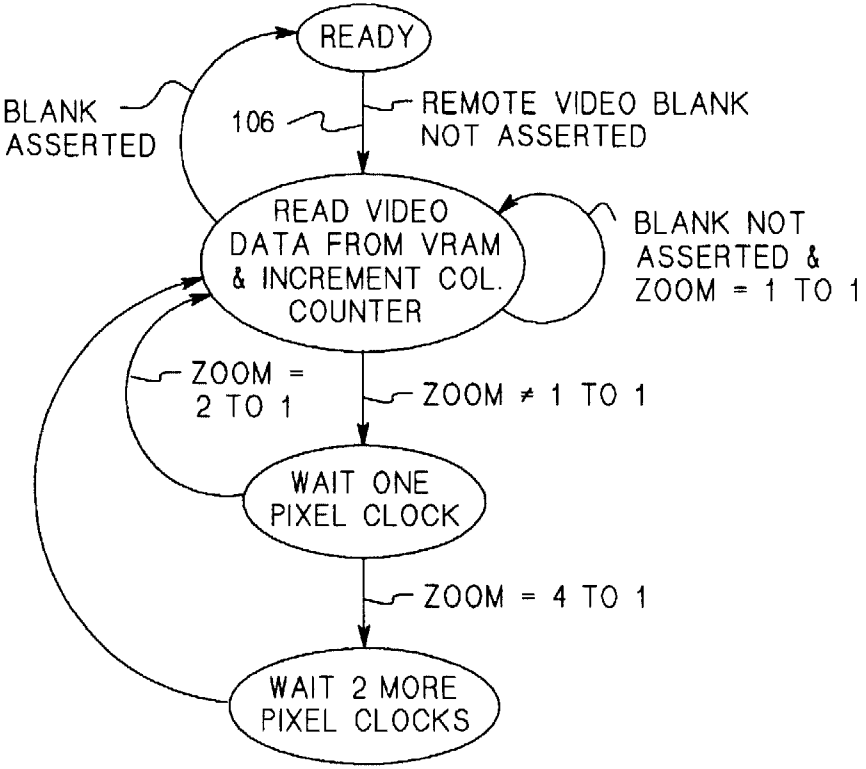
FIG. 12 is a state diagram of another portion of a video controller.

Referring to FIGS. 3 and 12, the video controller 51 as illustrated is also prompted by a signal 106 indicating times when video blanking for the display 52 is not being asserted. When blanking is not being asserted, the video controller reads video data from the remote video buffer 48 for transfer to the display and increments the column counter. For a selected zoom of greater than one-to-one, corresponding signals from the microcontroller 50B cause the video controller to wait a corresponding number of pixel clocks before transferring the next video data from the buffer to the display.

In each of the embodiments, the rate at which digital bits are transferred across the serial link (the "bit transfer rate") depends not only on the frame transfer rate but also on the number of pixels per frame, the number of bits per pixel and the number and frequency of non-video data transfers. As an example, consider a case in which the selected frame transfer rate is thirty frames per second, each frame comprises 640 columns by 480 rows of pixels, each pixel is defined by a nine-bit value, and two additional bits are needed to asynchronously transfer each pixel value across the serial link (e.g. 5B/6B encoding of the four most significant bits of a byte and 4B/5B encoding of the four least significant bits of the byte). The minimum bit transfer rate is calculated as follows: 30 frames/sec. ×(640×480) pixels/frame×11 bits/pixel =101,376,000 bits/sec. As explained above the preferred embodiments of the serial link have a 135 megabits/second capacity so the additional bandwidth (approximately 34 megabits/second) can be used to multiplex the non-video data transfers with the video pixel transfers without impacting the frame transfer rates.

In each of these embodiments, the local circuit's video frame buffer is updated at its regular rate, and the remote display monitor is refreshed at its normal rate. However, the video data can be transferred from the local circuit to the remote circuit at a much slower rate. This is because humans typically cannot perceive image changes occurring from one refresh to the next as long as the monitor's normal refresh rate is maintained to avoid noticeable flicker. So the rate at which the remote circuit's video frame buffer can be updated is a rate less then the remote display's refresh rate, depending only on humanly perceptible display changes rather than the refresh rate required by the remote display.

An important thing to note is that in all embodiments the video data transmitted to the remote circuit does not go through an analog stage. This is more efficient because typical transistor flat panel displays are inherently digital. In this way the analog stage is avoided entirely. It is also important to note that the video data are the digital values from the local color LUT, and that there is no decrease in performance in communications between the graphics programs being run by a host processor and the LUT. This is advantageous because conventional graphics programs typically manipulate the color LUT (write into and read from) extensively. So from the standpoint of graphics programs, this invention is transparent because it behaves exactly as a conventional graphics circuit in so far as data transfers to and from the color LUT.

There are several other advantages. First of all, only a single or a double fiber optic cable is required rather than other types of cable. Secondly, if, for some reason, the data link is disrupted, the remote terminal will still retain its last image. Moreover, the remote video frame buffer allows the remote monitor refresh to be asynchronous with the host computer's data transfers into the local video frame buffer.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, each of the host buses illustrated in the drawings need not be an open bus, but rather can be a closed bus or even a dedicated communication channel. As another example, the remote flat panel displays of all embodiments discussed above could be replaced by analog displays in which case a DAC would be interposed between the remote frame buffers and the analog displays.

I claim:

1. A system for coupling a source of display data to a remote monitor for real-time display of the data thereon, the system comprising:

(a) interface means, coupled to the source, for receiving in real-time units of display data from the source, (b) a transmission medium having a port remote from the interface means, (c) means for transmitting, at a selected unit transfer rate, units of display data via the transmission medium to the medium's remote port, (d) first memory means for time buffering a unit of display data between the interface means and the means for transmitting, (e) means for receiving, at the selected unit transfer rate, units of display data communicated to the remote port, (f) means for communicating received units of display data to the monitor at a rate compatible with data requirements of the monitor, and (h) second memory means for time buffering a received unit of display data between the means for receiving and the means for communicating.

2. The system according to claim 1 wherein:

(a) the units of display data each comprise a set of digital words, (b) the transmission medium comprises a serial medium, (c) the means for transmitting further comprises means for serializing digital words into corresponding serial signals for transmission of same over the serial medium, and (d) the means for receiving comprises means for deserializing serial signals into corresponding digital words.

3. The system according to claim 2 wherein:

(a) the serial medium comprises an optical medium, (b) the means for transmitting further comprises means for converting the serial signals to corresponding optical signals and transmitting the optical signals over the optical medium, and (c) the means for receiving further comprises means for sensing the transmitted optical signals and converting them to corresponding serial signals.

4. The system according to claim 1 wherein the units of display data are uniform and each comprises a set of pixel values corresponding to a display frame.

5. The system according to claim 1 wherein the unit transfer rate is less than the rate at which the interface means receives units of display data from the source.

6. A system for coupling a source of display data and non-display data to a remote monitor for real-time display and control of the display data thereon, the system comprising:

(a) interface means, coupled to the source, for receiving in real-time units of display data and non-display data from the source, (b) a data transmission medium having a port remote from the interface means, (c) means for transmitting, via the transmission medium at a selected unit transfer rate, units of display data and non-display data multiplexed in time to the medium's remote port, (d) first memory means for time buffering a unit of display data between the interface means and the means for transmitting, (e) second memory means for time buffering non-display data between the interface means and the means for transmitting, (f) means for receiving and demultiplexing units of display data and non-display data communicated to the remote port, (g) means for communicating received and demultiplexed units of display data to the monitor at a rate compatible with data requirements of the monitor, (h) third memory means for time buffering a unit of display data between the means for receiving and demultiplexing, and the means for communicating, (i) remote processing means, responsive to non-display data, for processing units of display data buffered in the third memory means according to at least one predetermined algorithm, and (j) fourth memory means for time buffering non-display data between the means for receiving and demultiplexing, and the remote processing means.

7. The system according to claim 6 wherein:

(a) the units of display data each comprise a set of digital words, (b) the transmission medium comprises a serial medium, (c) the means for transmitting further comprises means for serializing digital words into corresponding serial signals for transmission of same over the serial medium, and (d) the means for receiving and demultiplexing further comprises means for deserializing serial signals from the transmission medium into corresponding digital words.

8. The system according to claim 7 wherein:

(a) the serial medium comprises an optical medium, (b) the means for transmitting further comprises means for converting the serial signals to corresponding optical signals and transmitting the optical signals over the optical medium, and (c) the means for receiving and demultiplexing further comprises means for sensing the transmitted optical signals and converting them to corresponding serial signals.

9. The system according to claim 6 wherein the units of display data are uniform and each comprises a set of pixel values corresponding to a display frame.

10. The system according to claim 6 wherein the unit transfer rate is less than the rate at which the interface means receives units of display data from the source.

11. The system according to claim 6 further comprising data input port means, local to the monitor, for communicating operator inputs to the remote processor.

12. The system according to claim 11 wherein the remote processing means performs a preprogrammed algorithm in response to an operator input.

13. The system according to claim 11 wherein the remote processing means performs preprogrammed pan and zoom algorithms in response to corresponding operator inputs.

14. A system for coupling a processor to a remote monitor for real-time display and control of display data thereon, the system comprising:

(a) interface means, coupled to the processor, for receiving in real-time units of display data and non-display data from the processor, (b) a data transmission medium having a port remote from the interface means, (c) means for transmitting, via the transmission medium at a selected unit transfer rate, units of display data and non-display data multiplexed in time to the medium's remote port, (d) first memory means for time buffering a unit of display data between the interface means and the means for transmitting, (e) second memory means for time buffering non-display data between the interface means and the means for transmitting, (f) means for receiving and demultiplexing units of display data and non-display data communicated to the remote port, (g) means for communicating received and demultiplexed units of display data to the monitor at a rate compatible with data requirements of the monitor, (h) third memory means for time buffering a unit of display data between the means for receiving and demultiplexing, and the means for communicating, (i) remote processing means, responsive to non-display data, for processing units of display data buffered in the third memory means according to a predetermined algorithm, (j) fourth memory means for time buffering non-display data between the means for receiving and demultiplexing, and the remote processing means, (k) data port means, local to the monitor, for communicating with a data input device, (l) means for transmitting data input from the data port means to the interface means, (m) means for receiving and storing transmitted data input for access by the processor, and (n) means for notifying the processor that stored input data is available for access by the processor.

15. The system according to claim 14 wherein the means for transmitting input data from the data port means to the interface means comprises:

(a) a second transmission medium having a port local to the interface means, (b) means for transmitting the input data via the second transmission medium to the port local to the interface means, and (c) means for time buffering the input data between the data port means and the means for transmitting it.

16. The system according to claim 14 wherein the units of display data are uniform and each comprises a set of pixel values corresponding to a display frame.

17. The system according to claim 14 wherein the unit transfer rate is less than the rate at which the interface means receives units of display data from the source.

18. The system according to claim 14 wherein the data port means further comprises a communication path between an operator input device and the remote processing means, and wherein the remote processing means performs a preprogrammed algorithm in response to an operator input.

19. The system according to claim 18 wherein the remote processing means performs preprogrammed pan and zoom algorithms in response to corresponding operator inputs.

20. The system according to claim 6 further comprising means for sending selected link commands, from a set of predetermined link commands, across the medium at times between display data transmissions, said link commands being operational control signals.

* * * * *